US005126038A

United States Patent [19]

Nagaraj

[11] Patent Number: 5,126,038

[45] Date of Patent: Jun. 30, 1992

[54] PROCESS FOR IMPROVED PRECIOUS METALS RECOVERY FROM ORES WITH THE USE OF ALKYLHYDROXAMATE COLLECTORS

[75] Inventor: D. R. Nagaraj, Stamford, Conn.

[73] Assignee: American Cyanamid Company, Stamford, Conn.

[21] Appl. No.: 739,585

[22] Filed: Aug. 2, 1991

[51] Int. Cl.[5] ..... B03D 1/01; B03D 1/02

[52] U.S. Cl. ..... 209/166; 209/167

[58] Field of Search ..... 209/166, 167, 901; 252/61

[56] References Cited

U.S. PATENT DOCUMENTS

| | | | |
|---|---|---|---|
| 4,130,415 | 12/1978 | Nagaraj | 209/166 |
| 4,324,654 | 4/1982 | Rule | 209/166 |
| 4,629,556 | 12/1986 | Yoon | 209/166 |
| 4,676,890 | 6/1987 | Klimpel | 209/166 |
| 4,871,466 | 10/1989 | Wang | 209/166 |
| 4,929,343 | 5/1990 | Wang | 209/166 |
| 4,929,344 | 5/1990 | Fleming | 209/166 |

FOREIGN PATENT DOCUMENTS

| | | | |
|---|---|---|---|
| 381398 | 10/1973 | U.S.S.R. | 209/166 |
| 982810 | 12/1982 | U.S.S.R. | 209/166 |

OTHER PUBLICATIONS

"Mineral Flotation with Hydroxamate Collectors", by Fuerstenau and Pradip presented at Institute of Mining & Metallurgy, Sep. 18-21, 1984, pp. 161-168.

"Application of Hydroxamic Acid and Hydroxamic-Xanthate Collector System in Metal Ore Flotation", by Dekun et al; Presented at Institute of Mining and Metallurgy, Sep. 18-21, 1984, pp. 169-172.

"The Flotation of Copper Oxidized Ores with mixed Reagents of Hydroxamates and Xanthate", by Zhou et al., Sep. 22, 1984.

"Platnum Group Elements: Minerology, Geology, Recovery", by Cabri; Canadian Institute of Mining (vol. 23) pp. 1-3.

Chem. Abstract 104:54038c, Zhou et al.

*Primary Examiner*—Stanley S. Silverman

*Assistant Examiner*—Thomas M. Lithgow

[57] ABSTRACT

Collector compositions for use in froth flotation processes for the benefication of precious metals i.e. gold, silver and platinum group metals (PGM) from sulfide ores containing especially pyrrite and pyrrhotite are disclosed. The collector comprises alkyl hydroxamic acids or their alkali metal or ammonium salts, preferably in combination with standard sulfide ore collectors such as xanthates etc.

5 Claims, No Drawings

PROCESS FOR IMPROVED PRECIOUS METALS RECOVERY FROM ORES WITH THE USE OF ALKYLHYDROXAMATE COLLECTORS

BACKGROUND OF THE INVENTION

Alkyl or alkaryl hydroxamic acids and their salts are well-known collectors for the froth flotation of oxide minerals. A study of the available published literature indicates that the term "OXIDES" is used in a generic sense and includes oxides, carbonates, phosphates, fluorides, sulfates, silicates etc. of metals, and, as such, thereby excludes sulfides, coal and metallics or metalloids. Soviet workers have found a variety of applications for such hydroxamic acids. A recent review summarizes the flotation application of alkyl hydroxamic acids (Pradip and Fuerstenau, "Mineral Flotation with Hydroxamate Collectors", in "Reagents in the Minerals Industry", Ed. M. J. Jones and R. Oblatt, Inst. Min. Met., London, 1984, pp. 161–168). Hydroxamic acids have been used for the flotation of minerals such as pyrochlore (of Nb and Ta), fluoride, huebnerite, wolframite, cassiterite, muscovite, phosphorites, hematite, pyrolusite, phodonite, chrysocolla, malachite, barite, calcite, and rare-earths all belonging to the class of "oxides". Recently its use in the beneficiation of kaolin clays was disclosed (U.S. Pat. No. 4,629,556). Novel compositions containing alkyl hydroxamates have also been disclosed recently (U.S. Pat. No. 4,929,343). Alkyl hydroxamates have also been used in conjunction with xanthates for improved recovery of oxide copper minerals. Recently the use of a hydroxamic acid was disclosed for the recovery of oxide minerals containing copper, iron, gold and silver (Zhou, Wizhi, Kuangye Gongcheng, 1985, 5–1, pp. 25–9, and iron concentrates were recovered from associated oxide minerals by flotation of Au, Ag, and Cu oxide, using a hydroxamic acid and magnetic separation for Fe. Flotation of copper oxide ores with hydroxamate and xanthate was also reported (Zhou, Weizhi, Jinshu Xuebao, 1985, 21–3, pp. B105–B111). A copper concentrate (~26% Cu) was obtained at 80% recovery by flotation of copper oxide ore containing malachite and pseudomalachite with hydroxamate and xanthate as collector and regulator. Silver containing gold concentrate was obtained by this method from siliceous Cu-Fe oxide ore. Alkyl hydroxamic acids or their alkali metal salts have also been used in conjunction with conventional sulfide collection such as xanthates to enhance the recovery of copper oxides from mixed sulfide-oxide ores of copper. The sulfides in these ores are typically chalcopyrites ($CuFeS_2$), chalcocite ($Cu_2S$), covellite ($CuS$) etc. and the oxides are typically malachite ($CuCO_3$, $Cu(OH)_2$), cuprite ($Cu_2O$), tenorite ($CuO$), and chrysocolla ($CuSiO_3$) see U.S. Pat. No. 4,324,654.

While all of this extensive published literature certainly represents advancement of the art of flotation of oxide minerals with hydroxamates, there are still many unknowns in this art. The literature information adequately teaches that hydroxamates can float a variety of oxide minerals of many metals, yet it is not possible for those skilled in the art to predict the behavior of hydroxamates when applied to ores that are not characterized as the traditional oxides. The published literature also adequately teaches that hydroxamates are not used solely in the flotation of copper sulfide ores (for example, the prophyry or primary ore), but rather it is used in conjunction with the traditional sulfide collectors for the sole purpose of improving the recovery of oxide copper minerals which are not floated effectively by sulfide collectors. Indeed, it is not possible to predict the behavior of hydroxamates as collectors for complex ores such as the Cu-Pb-Zn-Fe, Ni-Co-Cu-Fe, Cu-Zn, Pb-Zn and massive sulfide ores. Recently alkyl hydroxamates were evaluated for the flotation beneficiation of such a complex, polymetallic ore containing nickel, copper, gold and uranium (Collee, R. Monfort, G. and Windels, F. Valorisation des minerals de cobalt Etude experimentale d'un gisement, in Annales des Mines de Belgigue, 1985, 3–4, pp. 106–131). This polymetallic deposit contained notably sulfides and arsenides (safflorite, pyrite, skutterudite, remmelsbergite, chalcopyrite, orpiments, mispickel), oxides and hydroxides (magnetitute, rutile, hematite, goethite, erythrine, pitchblende, heterogenite, brannerite), carbonates (spherocobaltite, dolmite, calcite), silicates (quartz, clay, various micas, feldspars, pyroxenes) and elements (gold, graphite). Most of the traditionally used sulfides and non-sulfide collectors were tested. The experimental reagents were notably of the following trademark types: Cataflot, Noramac, Orzan, Quebracho, Aerodepressant, AeroPromotor, Aeromine and chemicals: methylisobutylcarbinol, oleic acid, ascorbic acid, sulfides and alkaline disulfides, arkomon, amyl xanthates, ethyl xanthates, alkaline disulfides, isopropropyl ethyl thionocarbamates, sulfuric acid, sodium carbonate, sodium silicate, pine oil, terpeniol, cresol, aliphatic alcohols, sulfoesters, alkyldithiophosphates, fatty acids, petronates, sulfonates. The flotation results showed the sluggish kinetics of flotation phenomena of these ores. The operating conditions were varied to include laurohydroxamates with or without sulfuration to xanthates, variable pH, hydroxamic acid mixtures, or mixtures of their alkaline salts, mixtures of laurylamine chlorides, with or without sodium silicate and with sodium sulfhydrate. The experimental results of flotation by hydroxamate reagents were able to show the sometimes beneficial influence of these reagents, i.e. their catalyzing effect on the floatability of several cobalt oxides were predictable from the literature teachings, and one can conclude from the study that there was no unusual benefit from the use of hydroxamates per se.

SUMMARY OF THE INVENTION

We have now found unexpectedly that when alkyl hydroxamic acids or their salts i.e those disclosed in U.S. Pat. No. 4,929,343, are used alone or in conjunction with traditional, sulfide collectors on sulfide ores containing pyrite, pyrrhotite, pentlandite, chalcopyrite, and precious metals, notably the platinum-group elements (PGEs), the kinetics of flotation and overall recovery of these precious metals are increased quite significantly. Such a finding is unexpected based on the teachings in the literature i.e. that hydroxamates are excellent collectors for oxide ores and minerals, but not for sulfide ores and minerals. These ores containing the precious metals, notably PGEs, have been beneficiated for decades and traditional sulfide collectors have been well established as the best collectors, though numerous other collectors have been evaluated for a number of years.

In accordance with the present invention, there is sulfide ores containing gold, silver and platinum group metals e.g. palladium, said process comprising: grinding said sulfide ore to provide particles of flotation size, slurrying said particles in an aqueous medium, conditioning said slurry with effective amounts of a frothing agent and a metal collector, frothing the desired minerals preferentially over gangue minerals by froth flotation procedures at a pH over about 7.0; said metal collector comprising at least one alkyl hydroxamic acid or its salt having the formula:

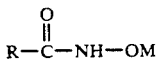

wherein R is a $C_6$–$C_{22}$ alkyl group and M is hydrogen, an alkali metal or an ammonium ion.

The alkylhydroxamic acid or salt collectors and the process of the present invention unexpectedly provide superior recovery of gold, silver and platinum group metals in froth flotation separations as compared with many conventional sulfide collectors, even at reduced collector dosages, under conditions of alkaline pH.

Other objects and advantages of the present invention will become apparent from the following detailed description and illustrative working examples.

DETAILED DESCRIPTION OF THE INVENTION

In accordance with the present invention, gold, silver and platinum group metal values are recovered by froth flotation methods in the presence of a novel collector, said collector comprising an alkyl hydroxamic acid or salt of the above formula. The R radicals of the formula may be selected from n-hexyl, cyclohexyl, heptyl, octyl, dodecyl, stearyl groups and the like.

Illustrative compounds within the above formula for use as collectors in accordance with the present invention include cyclohexylhydroxamic acid, n-octyl hydroxamic acid, dodecyl hydroxamic acid, stearyl hydroxamic acid etc. or their salts of e.g. sodium, potassium, or ammonium.

The alkylhydroxamic acids or salts of the present invention may be conveniently prepared as described in U.S. Pat. No. 4,871,466 hereby incorporated herein by reference. They are preferably used as solutions in $C_8$–$C_{22}$ alcohols such as octyl alcohol, decyl alcohol, tridecyl alcohol etc. at about 75–175 parts of alcohol per 100 parts of alkylhydroxamic acid or salt. Water may also be included at 30–50%, by weight.

In accordance with the present invention, the above-described alkylhydroxamic acids or salts are employed as collectors in a new and improved froth flotation process which provides a method for the enhanced beneficiation of gold, silver and platinum group values from sulfide ores containing especially pyrite, pyrrhotite, and pentlandite, under alkaline conditions.

In accordance with the present invention, the new and improved process for the benefication of gold, silver and platinum group values from sulfide ores comprises, firstly, the step of size-reducing the ore to provide ore particles of flotation size. Generally, and without limitation, suitable particle size will vary from between about 5 microns to about 30 microns to about 200 microns. Especially preferable for use in the present method are base metal ores which have been size-reduced to provide from about 14% to about 30%, by weight, of particles of +75 microns and from about 40% to about 90%, by weight, of particles of −38 microns.

Size reduction of the ores may be performed in accordance with any method known to those skilled in this art.

Preadjustment of pH is conveniently performed by addition of the pH modifier to the grind during the size reduction step.

The pH of the pulp slurry may be preadjusted to any desired value by the addition of lime etc. Thus, for example, excellent selective benefication has been obtained in accordance with the process of the present invention at pH values of over 6.0 to about 11.0, preferably from about 7.0 to about 10.0.

The size-reduced ore, e.g., comprising particles of liberation size, is thereafter slurried in aqueous medium to provide a floatable pulp. The aqueous slurry or pulp of flotation sized ore particles, typically in a flotation apparatus, is adjusted to provide a pulp slurry which contains from about 10 to 60%, by weight, of pulp solids, preferably 25 to 50%, by weight, and especially preferably from about 30% to about 40%, by weight.

In accordance with a preferred embodiment of the process of the present invention, the flotation of gold, silver and platinum group metals is performed at a pH of from about 8.5 to about 10.0. It has been discovered that in conducting flotation at this pH range, the collectors of the present invention exhibit exceptionally high collector strength, together with excellent collector selectivity, even at reduced collector dosages.

After the pulp slurry has been prepared, the slurry is conditioned by adding effective amounts of a frothing agent and a collector comprising at least one alkylhydroxamte as described above. By "effective amount" is meant any amount of the respective components which provides a desired level of benefication of the desired metal values. Generally, about 0.005 to about 1.0 lb. of collector per ton of ore is sufficient.

Any known frothing agent may be employed in the process of the present invention. By way of illustration, such frothing agents as straight or branched chain low molecular weight hydrocarbon alcohols, such as $C_6$–$C_8$ alkanols, 2-ethyl hexanol, 4-methyl-2-pentanol, also known as methyl isobutyl carbinol (MIBC) may be employed, as well as pine oils, cresylic acid, polyglycol or monoethers of polyglcols and alcohol ethxylates, to name but a few. Generally, and without limitation, the frothing agent(s) will be added in conventional amounts and amounts of from about 0.01 to about 0.2 pound of frothing agent per ton of ore treated, are suitable.

Thereafter, the conditioned slurry, containing an effective amount of frothing agent and an effective amount of collector, is subjected to a frothing step in accordance with conventional froth flotation methods to float the desired gold, silver and/or platinum group metal values in the forth concentrate and selectively reject or depress other oxide gangue such as silicates; quartz, carbonates etc.

The improved collectors of the present invention may be added to the flotation cell as well as to the grind.

The collectors of the present invention are preferably used in conjunction with such primary sulfide collectors as alkyl xanthates, dialkyldithiophosphates and dithiophosphinates, dialkylthionocarbamates, dialkyl and diaryl thioureas, mercaptobenzothiazoles, alkyl xanthogen alkyl formates, hydrocarboxycarbonyl thioncarbamates or thioureas, and the like, in amounts up to about 60.0%, by weight, based on the total weight of the alkylhydroxamic acid or salt represented in the formula above, preferably up to about 40%, by weight, same basis.

The following examples are set froth for purposes of illustration only and are not to be construed as limiting the instant invention except as set forth in the appended claims. All parts and percentages are by weight unless otherwise specified.

EXAMPLE 1

The ore consists of a massive pyrrhotite (iron sulfides) ore body containing the sulfide minerals pentlandite (iron nickel sulfide), and chalcopyrite (copper iron sulfide). The valuable minerals (PGM+Au) are contained within the pyrrhotite and pentlandite. The final plant product is a bulk sulfide concentrate at 30% sulfide sulfur (SS) assay and is supplied to a smelter/refinery for production of nickel, copper and PGM's. Rougher grade is about 20% Sulfide Sulphur.

The ore process route involves grinding to 70% passing 74 microns and flotation of the feed to a grade of 30% SS after rougher and two cleaner flotation stages. Mixture A is a 2:1 blend of mercaptobenzothiazole and diisobutyldithiophosphate. Sodium carbonate is added to obtain a pH of about 9.5. Sodium propyl xanthate usage is about 40 g/t total (in 3 stages to the rougher), and the same for Mixture A. A polyglycol frother is used. A polysaccharide depressant is used in the first stage to depress silicates.

The effect of a dodecanol solution $C_8$-$C_{10}$ alkyl hydroxamic acid (abbreviated HX/DA) is evaluated as per the procedure above. The results are summarized in Table I.

TABLE I

| REAGENTS | RECOVERY % Nickel | Sulphur | AT 20% SULFIDE Pt | SUL-PHUR Pd |
|---|---|---|---|---|
| XANTHATE 20, 10, 10 gpt MIXTURE A 20, 10, 10 gpt | 53 | 34 | 45 | 44 |
| XANTHATE 20, 10, 10 gpt MIXTURE A 20, 10, 10 gpt COLLECTOR HX/DA 100 gpt | did not achieve grade, foamed | | | |
| XANTHATE 20, 10, 10 gpt MIXTURE A 20, 10, 10 gpt COLLECTOR HX/DA 20, 20, 20 gpt | 62 | 54 | 49 | 52 |
| XANTHATE 20, 10, 10 gpt MIXTURE A 20, 10, 10 gpt COLLECTOR HX/DA 50, 20, 20 gpt | 79 | 77 | 63 | 66 |

As can be seen, the addition of the hydroxamic collector HX/CA improves recoveries of nickel, platinum and palladium at the benchmark of 20% sulphide sulphur (roughter float) by considerable amounts. This alters the economic operation of this ore body significantly. Traditional sulfide caollectors alone could not achieve such improved recoveries.

EXAMPLE 2

This ore differs from that used in Example 1 in terms of (PGM & Au) distribution. Also, the final product is based on a target of 100-125 gpt of (PGM+Au).

Run of mine ore is fed to the crusher plant and then to grinding. Final size analysis is 66% passing 74 microns. The depressant is a polysaccharide as used in Example 1 (at 300 g/t).

The pH is approximately 8.8. Copper sulfate is used to activate the sulfide minerals. The collector is again a dodecyl alcohol solution of $C_{8-C10}$ hydroxamic acid (HX/DA) which is added in conjunction with xanthate. The results are summarized in the Table II, below.

TABLE II

| Reagent | Platinum Group Metals and Gold Rate of Recovery Minutes 0-1 | 0-4 | 0-8 | Grade First Stage conc. gpt |
|---|---|---|---|---|
| xanthate 34 gpt: | 36.17 | 55.60 | 62.08 | 139 |
| xanthate 68 gpt: | 27.44 | 76.24 | 88.18 | 88 |
| xanthate 34 gpt HX/DA 8 gpt: | 68.52 | 84.73 | 90.95 | 131 |

These results demonstrate clearly that the use of a hydroxamic acid in conjunction with xanthate produces a signficant increase in the rate of flotation of PGM & Au at nominally the same grade of the precious metals in the concentrate. It can also be noted that merely increasing the xanthate dosage reduces both rate and grade significantly.

EXAMPLE 3

This example demonstrates the kinetic effect of the collector of Example 1 and 2 leading to enhanced recoveries at certain times in the process.

This is a pyrrhotite ore containing pentlandite and chalcopyrite and PGM+Au.

A sample of feed to the float section in the plant is taken and subsampled for analysis prior to being divided into the necessary fractions for lab tests.

The lab feed sample is conditioned and pH adjusted to 9.0 with $Na_2CO_3$. The pulp sample is then conditioned with the floatation reagents prior to conducting flotation. The results are summarized in Table III. The collector HX/DA, as used in previous examples, is added to the conditioning stage along with the standard xanthate collector.

TABLE III

| Reagents | time-minutes 2 | 4 | 6 |
|---|---|---|---|
| a) Nickel | | | |
| | Recovery, % Ni | | |
| standard xanthate 15 gpt | 54 | 71 | 79 |
| xanthate 15 gpt collector HX/DA 10 gpt | 67 | 80 | 85 |
| xanthate 15 gpt collector HX/DA 20 gpt | 67 | 81 | 87 |
| xanthate 15 gpt collector HX/DA 50 gpt | 67 | 81 | 87 |
| b) PGM + Au | | | |
| | Recovery, % PGM + Au | | |
| standard xanthate 15 gpt | 59 | 75 | 83 |
| xanthate 15 gpt HX/DA 10 gpt | 72 | 84 | 88 |
| xanthate 15 gpt HX/DA 30 gpt | 72 | 84 | 88 |
| xanthate 15 gpt HX/DA 50 gpt | 72 | 84 | 88 |
| c) Sulfur | | | |
| | Recovery, % Sulfide Sulphur | | |
| standard xanthate 15 gpt | 53 | 70 | 80 |
| xanthate 15 gpt | 72 | 85 | 90 |

TABLE III-continued

| Reagents | time-minutes 2 | 4 | 6 |
|---|---|---|---|
| HX/DA 10 gpt | | | |
| xanthate 15 gpt | 75 | 87 | 92 |
| HX/DA 30 gpt | | | |
| xanthate 15 gpt | 77 | 88 | 93 |
| HX/DA 30 gpt | | | |

These results once again demonstrate clearly that both recoveries and rates of PGM+Au are increased wih the use of alkyl hydroxamic acid along with xanthate.

EXAMPLE 4

An ore containing gold as the primary value is used in this example. This ore also containes small amounts of pyrite, pyrrhotite, and chalcopyrite. The ground pulp is adjusted to pH 9.3 using sodium carbonate. It is then conditioned with xanthate and dithiophosphate. $C_{8-C10}$ alkyl hydroxamic acid (HX/DA) is added at 100 gpt along with the xanthate and dithiophosphate. The results are given in Table IV, below.

TABLE IV

| | | Gold - containing Sulfide ore | | | |
|---|---|---|---|---|---|
| | | Au Recovery % | | Au Grade oz/t | |
| Reagent | g/t | Stge 1 | Stge 1 & 2 | Stge 1 | Stge 1 & 2 |
| xanthate | 50 + 25 | 54.8 | 61.0 | 0.67 | 0.48 |
| dithio-phosphate | 20 + 20 | | | | |
| xanthate | 50 + 20 | 66.1 | 70.6 | 1.562 | 0.884 |
| dithio-phosphate | 20 + 20 | | | | |
| HX/DA | 100 | | | | |

It is demonstrated that both recovery and grade of gold are improved significantly wih the use of alkyl hydroxamic acid collector HX/DA.

EXAMPLES 5-9

Following the procedure of Example 1 except that a different pH is used, various collectors falling within the scope of this invention are tested as precious metals collectors on gold and other ores. The compositions and other variables are set froth in Table V, below. Similar results are achieved.

TABLE V

| Example | Hydroxamate Collector R | X | Primary Ore Metal | Sulfide Collector | pH |
|---|---|---|---|---|---|
| 5 | decyl | Na | Au | MBT | 8.2 |

TABLE V-continued

| Example | Hydroxamate Collector R | X | Primary Ore Metal | Sulfide Collector | pH |
|---|---|---|---|---|---|
| 6 | dodecyl | $NH_4$ | Pt/Pd | TU | 9.1 |
| 7 | cyclohexyl | K | Au | DTC | 7.4 |
| 8 | n-octyl | $NH_4$ | Au | DTP | 7.9 |
| 9 | stearyl | Na | Ag | none | 8.8 |

TU = Dialkylthiourea
MBT = mercaptobenzothiazole
DTC = Dialkylthionocarbamate
DTP = Dialkyldithiophosphate

We claim:

1. In a froth flotation process for beneficiating sulfide ores containing at least one selected from the group consisting of platinum group metals, gold, and silver and sulfide minerals containing at least one selected from the group consisting of platinum group metals, gold and silver comprising slurrying liberation-sized particles of said ore in an aqueous medium, conditioning the resultant slurry with effective amounts of a frothing agent and a collector, respectively, and floating at least one of the group selected from platinum group metals, gold silver and sulfide minerals containing at least one selected from the group consisting of platinum group metals, gold and silver by froth flotation methods, the improvement comprising: employing, as the collector, at a pH of above about 7.0, at least one compound having the formula:

$$R-\overset{\overset{\displaystyle O}{\|}}{C}-NH-OM$$

wherein R is a $C_{6-C22}$ alkyl group and M is hydrogen, an alkali metal or ammonium, and recovering from the float fraction at least one selected from the group consisting of gold, silver, platinum group metals and sulfide minerals containing at least one selected from the group consisting of gold silver and platinum group metals therefrom.

2. The process of claim 1 wherein said collector is added in an amount of from about 0.0005 to about 0.5 lb/ton of ore.

3. The process of claim 1 wherein said aqueous slurry of liberation-sized ore particles has a pH value of from above about 7.0 to about 12.0.

4. The process according to claim 1 wherein said compound is employed in conjunction with a sulfide collector.

5. The process according to claim 4 wherein said sulfide collector is selected from alkyl xanthates, dialkyldithiophosphates, dialkyldithiophosphinates, dialkyldithionocarbamates, dialkyl and diaryl thioureas, mercaptobenzothiazoles, alkyl xanthogen alkyl formates and hydrocarboxylcarbonyl thionoarbamates or thioureas.

* * * * *